US005947327A

United States Patent [19]

Lee

[11] Patent Number: 5,947,327

[45] Date of Patent: Sep. 7, 1999

[54] POWER SAVING APPARATUS OF AN AUTOMATIC VENDING MACHINE AND METHOD THEREOF

[75] Inventor: Hee-Soo Lee, Kwangju, Rep. of Korea

[73] Assignee: Kwangju Electronics Co., Ltd., Kwangju, Rep. of Korea

[21] Appl. No.: 08/866,184

[22] Filed: May 30, 1997

[30] Foreign Application Priority Data

Jul. 13, 1996 [KR] Rep. of Korea ..... 96 20752
Mar. 3, 1997 [KR] Rep. of Korea ..... 97 6959

[51] Int. Cl.[6] ..... G07F 11/00

[52] U.S. Cl. ..... 221/6; 221/17

[58] Field of Search ..... 221/2, 6, 7, 9, 221/13, 17, 150 R, 258

[56] References Cited

U.S. PATENT DOCUMENTS 5,097,981 3/1992 Degasperi et al. ..... 221/6

*Primary Examiner*—Kenneth Noland
*Attorney, Agent, or Firm*—Perman & Green, LLP

[57] ABSTRACT

The present invention is disclosed to provide a power saving apparatus and a method for reducing an electric power of the automatic vending machine when goods stored or provided at an inner part of the automatic vending machine is maintained at a goods sold out state or when an error occurs due to some trouble at a predetermined load(s) of the inner part of the automatic vending machine. In the automatic vending machine, with an operating time of a heater and a compressor being reduced power consumption to be used at the sales stop state of the automatic vending machine can be reduced according to reduced operating time of the inner load at a predetermined ratio.

2 Claims, 2 Drawing Sheets

POWER SAVING APPARATUS OF AN AUTOMATIC VENDING MACHINE AND METHOD THEREOF

BACKGROUND OF THE INVENTION

1. Field of the Invention

The present invention relates to a power saving apparatus of an automatic vending machine and method thereof and more particularly to a power saving apparatus of an automatic vending machine and a method thereof for reducing an electric power consumed therein in case goods stored or provided at an inner part thereof is sold out or an error occurs.

2. Description of the Prior Art

Generally, automatic vending machines have been widely used, in various countries. The automatic vending machines, such as, coffee, cigarette, cake, and candy vending machines, have goods keeping chambers therein. In these automatic vending machines, when coins are inserted by the user into the automatic vending machine and a selecting button is pushed to a predetermined goods, goods is extracted from an extract part of the automatic vending machine.

As shown in FIG. 1, a goods selecting apparatus of a conventional automatic vending machines includes a coin sensing mechanism 1 for sensing a state of inserted coins and an amount of money to be inserted in the automatic vending machine, a goods selecting part 2 for selecting a predetermined article among goods stored or provided at the automatic vending machine, a control part 3 for displaying a selling possibility state according to a sensing signal corresponding to the inserted coins and the amount of the money input from the coin sensing mechanism 1 and for generating a control signal to extract goods selected from the goods selecting part 2, and a goods extracting part 5 for extracting the selected goods according to an extract control signal from the control part 3.

Now, goods selecting operation process of the conventional automatic vending machine will be explained hereinafter.

When coins are inserted through a coin inserting slot (not shown) of the automatic vending machine, condition of the coins or a bill and amount of money are sensed by a plurality of sensors (not shown) of the coin sensing mechanism 1 and a signal sensed therefrom is provided with the control part 3. The control part 3 generates a control signal for displaying a total inserted amount of money according to the sensing signal from the coin sensing mechanism 1 and also generates a control signal for displaying a state of goods selling possibility in case of the inserted money excessing the selling price of the goods.

After the state of the goods selling possibility shown in the display part 4 is confirmed a selecting button is pushed by a user to be selected goods. A button signal corresponding to the goods selected from goods selecting part 2 by the user is provided with the control part 3. At this time, a control signal for extracting the selected goods is generated from the control part 3.

Accordingly, the user can obtain at any time a predetermined article among goods stored in the automatic vending machine, thus controlling and adjusting the extracting control signal from the control part 3.

When the automatic vending machine is not operated due to a sold-out state of goods and/or no paper cups or no changes available, a predetermined display portion(not shown)of the automatic vending machine is displayed with a no-sale state by a display control signal output from the control part 3.

In the conventional automatic vending machine, a heater and a compressor mounted at an inner part of the automatic vending machine is continuously provided with an AC power even in case of displaying the no-sale state. That is, the power is unnecessarily consumed because the heater and the compressor are continuously provided with the power during the no-sales of the automatic vending machine.

SUMMARY OF THE INVENTION

The principal object of the present invention is to provide a power saving apparatus of an automatic vending machine and a method thereof for controlling an operating time of inner loads during a no-sale state of the automatic vending machine.

According to the present invention, there is provided with a power saving apparatus of an automatic vending machine, the apparatus comprising:

- a goods sold-out state detecting part for detecting a sold-out state of goods stored and/or provided at a predetermined part of the automatic vending machine;
- a failure detecting part for detecting a trouble state of an inner load of the automatic vending machine;
- a control part for determining the sold-out state of the goods stored at said automatic vending machine by a detecting signal from said goods sold-out state detecting part, and a no-sales state when trouble or failure occurs in the inner load of the automatic vending machine by a detecting signal from said failure detecting part, and for generating a control signal for controlling an operating time of each load of the inner part of said automatic vending machine;
- a display part for displaying the no-sales state according to a display control signal output from the control part; and,
- a driving control part for controlling the operating time of each load according to a control signal output from the control part.

According to the present invention, there is also provided with a power saving method of an automatic vending machine, the method comprising the steps of:

- displaying an operating state through a display part of the automatic vending machine after prosecuting a predetermined initial work when an AC voltage provided from an outside is supplied with the automatic vending machine;
- detecting a goods sold-out state by the goods sold-out state detecting part while being sold the goods provided at the automatic vending machine;
- detecting a trouble or failure of an inner load of said automatic vending machine by the failure detecting part while being sold of the goods provided at the automatic vending machine;
- displaying a no-sales state according to the goods sold-out state, a trouble or failure of the inner load of the automatic vending machine; and
- reducing an operating time of each load at a predetermined rate.

DESCRIPTION OF THE PREFERRED EMBODIMENT

The present invention will now be described in detail with reference to the accompanying drawings.

Figure 1:
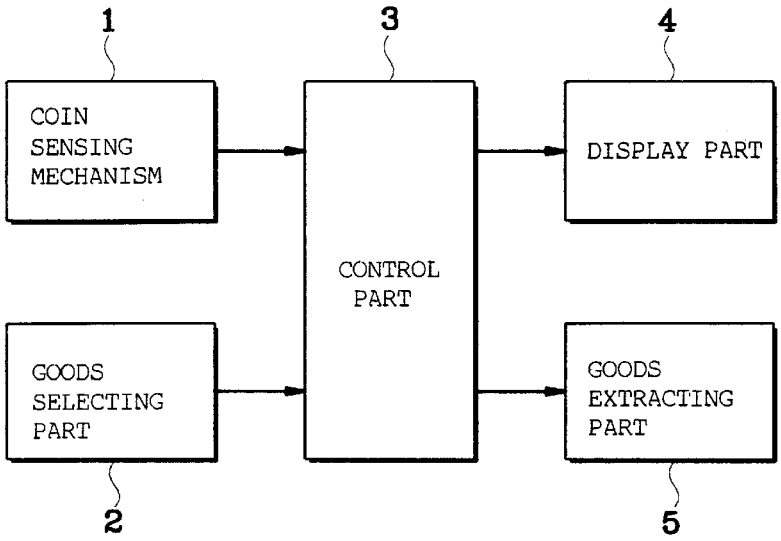
FIG. 1 is a block diagram of a conventional automatic vending machine.
Figure 2:
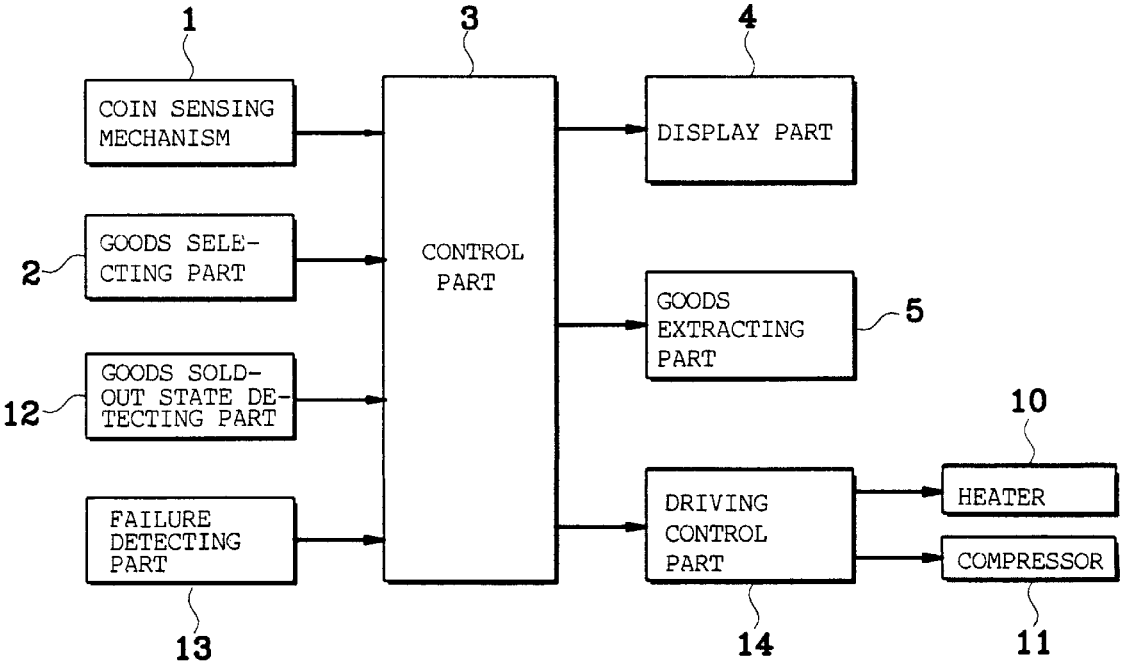
FIG. 2 is a schematic block diagram of a power saving apparatus of an automatic vending machine according to a preferred embodiment of the present invention.

In FIG. 2, reference numeral 3 is a control part of the automatic vending machine. Inner apparatus including a coin sensing mechanism 1, a goods selecting part 2, and a goods extracting and a display part 4 described in a preferred embodiments of the present invention are similarly constructed as those of the conventional automatic vending machine and redundunt description of the elements will be not described hereinafter.

As shown in FIG. 2, a goods sold-out state detecting part 12 detects a sold-out state of the goods (not shown) stored or provided at a predetermined portion of the automatic vending machine. A signal detected from the goods sold-out state detecting part 12 is supplied to the control part 3.

A failure detecting part 13 detects a trouble state of inner loads of the automatic vending machine. A signal detected from the failure detecting part 13 is supplied to the control part 3.

The control part 3 serves to generate a control signal for displaying a no sale state according to the signal detected from the goods sold-out state detecting part 12 or failure detecting part 13 and to generate a control signal for operation a heater 10 and a compressor 11 at a predetermined reduced operation rate ( by way of example, 50% reduction).

A driving control part 14 generates control signals to control an operating time of the heater 10 and the compressor 11 according to the control signal generated from the control part 3.

Goods stored at the automatic vending machine is maintained at a predetermined temperature by operating the heater 10. Also, the goods is cooled by operating the compressor 11 according to the control signal of the driving control part 14.

Figure 3:
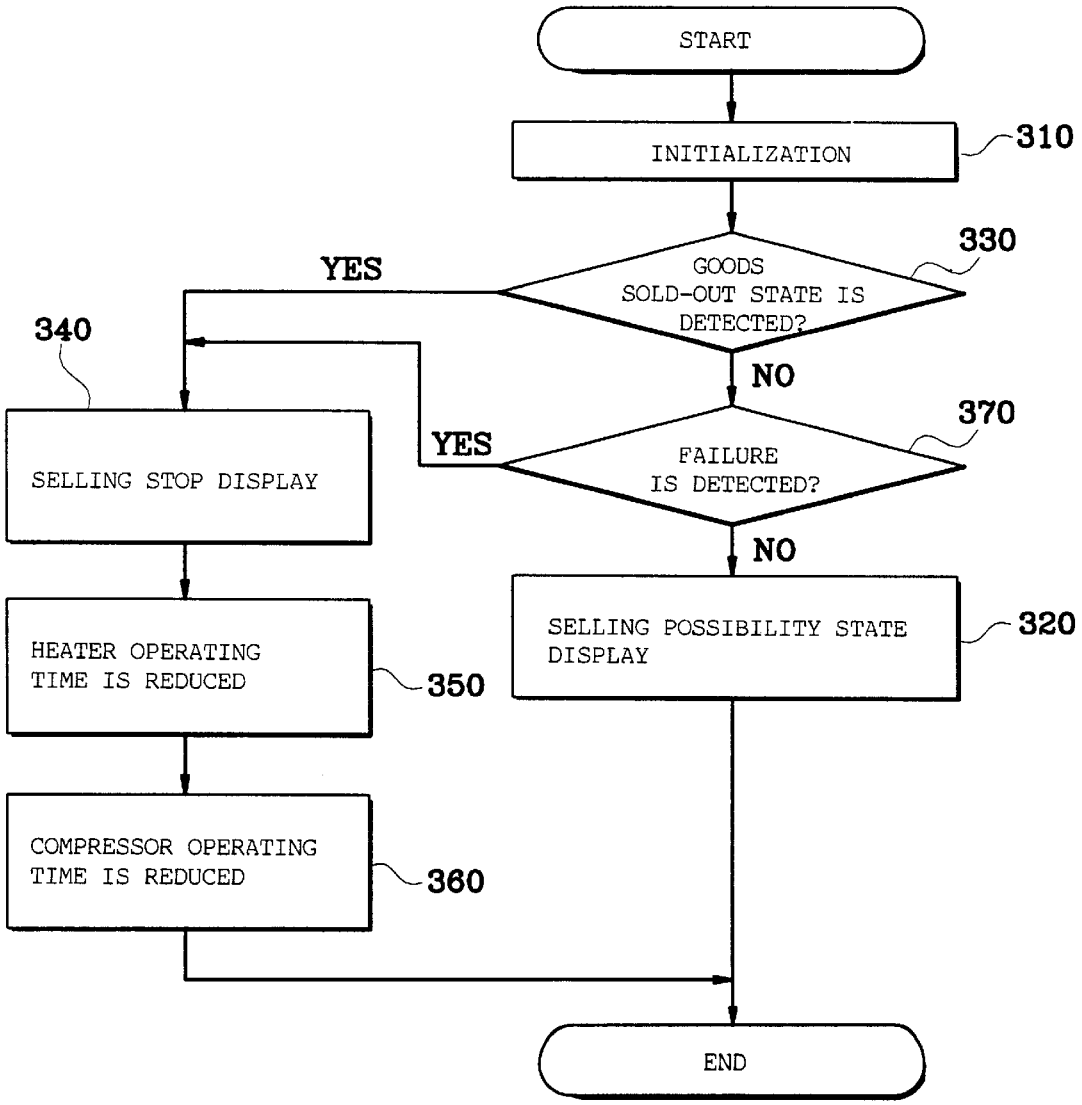
FIG. 3 is a flow chart showing a power saving method of the automatic vending machine according to the preferred embodiment of the present invention.

FIG. 3 shows a flow chart showing a power saving method of the automatic vending machine according to the preferred embodiment of the present invention. Reference symbol S defines steps.

When an AC voltage provided from outside is provided with the automatic vending machine, the automatic vending machine starts to be initialized with predetermined input parameters by the control signal from the control part 3, step S310.

After prosecuting the initialization at step S310, the user can judge a display state (for example, "on sale") of the display part 4 in case of a normal state of the automatic vending machine. That is, a sales possibility state is displayed for proceeding and prosecuting the sales, step S320.

In this normal condition, the user is able to purchase a desired goods by using the automatic vending machine. The purchase method of the automatic vending machine is similar to that of the conventional automatic vending machine.

That is, coin or a bill is inserted into a slot of the automatic vending machine by the user for goods to be sold displayed at the panel (not shown) of the automatic vending machine. A selecting button corresponding to a goods desired by the user is pushed.

Accordingly, the control part 3 generates a control signal to extract the goods through the goods extracting part 5.

At normal state quantity of the goods is detected by the goods sold-out detecting part 7 at step S330. When a sold-out state of goods is detected, a detected signal indicative of goods being sold out is provided to the control part 3. In the control part 3, a control signal for displaying the goods sold-out state is generated. Also, other control signals are generated for reducing the operating time of the heater 10 and the compressor 11 at a predetermined ratio (for example, 50%).

Accordingly, the goods sold-out state is displayed at the display part 4 according to the control signal from the control part 3 at step S340.

Subsequently, at steps S350 and S360 the operating time of the heater 10 and the compressor 11 is adjusted to the predetermined ratio (by way of example, 50%).

Accordingly, the driving control part 9 drives the heater 10 for the adjusted operating time at step 350 for keeping the goods warm.

Furthermore, the driving control part 7 drives the compressor 11 for the adjusted operating time at step 360 for keeping the goods cool.

Further, in case of failure occurs at the automatic vending machine, the control part 3 generates a control signal according to a signal detected from the failure detecting part 8 at step 370. That is, in the control part 3, a control signal is generated for reducing an operating time of the heater 10 and the compressor 11 at a predetermined ratio, and, at the same time a control signal is generated for displaying the trouble state of the automatic vending machine.

Accordingly, the driving control part 9 drives the heater 10 for the adjusted operating time at step 350 for keeping the goods warm.

Furthermore, the driving control part 7 drives the compressor 11 for the adjusted operating time at step 360 for keeping the goods cool.

As explained above, there is an advantage in the present invention, in that an AC power being applied to the automatic vending machine is controlled and adjusted operation time(s) of the heater and the compressor with a predetermined ratio during selling stop state.

In the automatic vending machine as described above, with operating time of the heater 11 and the compressor 11 being reduced, the AC voltage consumption during the selling stop state of the automatic vending machine can be reduced with a predetermined ratio.

This invention has been described in detail in connection with the preferred embodiment, but this embodiment is by way of example only and is not to be considered as restricted thereto. It will be easily understood by those skilled in the art that other variations and modifications can be easily made within the scope of the invention as claimed.

What is claimed is:

1. A power saving apparatus of an automatic vending machine, the apparatus comprising:

a goods sold-out state detecting part for judging and detecting a sold-out state of goods stored and/or provided at a predetermined part of the automatic vending machine;

an inner apparatus within said automatic vending machine including a coin sensing mechanism, a goods selecting part and a goods extracting part, a failure detecting part for detecting a trouble state of the inner apparatus of the automatic vending machine;

a control part for determining the sold-out state of the goods stored at said automatic vending machine by a detecting signal from said failure detecting part, and for generating a control signal for controlling an operating time of each load of the inner apparatus of said automatic vending machine;

a display part for displaying the no sales state according to the display control signal output from the control part; and a driving control part for adjusting and controlling the operating time of each load according to a control signal output from the control part.

2. A power saving method of an automatic vending machine, the method comprising the steps of:

displaying an operating state through a display part of the automatic vending machine after prosecuting a predetermined initial work when an AC voltage provided from an outside is supplied with the automatic vending machine;

detecting a goods sold-out state by the goods sold-out state detecting part while being sold the goods provided at the automatic vending machine;

detecting a trouble or failure of an inner apparatus including a coin selecting mechanism, a goods selecting part and a goods extracting part of said automatic vending machine by the failure detecting part while being sold the goods provided at the automatic vending machine;

displaying a no sales state according to the goods sold-out state, a trouble or failure of the inner apparatus of the automatic vending machine; and reducing an operating time of each load at a predetermined rate.

* * * * *